United States Patent [19]

McCulloch et al.

[11] 3,977,924

[45] Aug. 31, 1976

[54] COOLANT ADDITIVES FOR NITROGEN GENERATING SOLID PROPELLANTS

[75] Inventors: Charles R. McCulloch, Shalimar, Fla.; Gerald L. MacKenzie, Port Tobacco, Md.

[73] Assignee: The United States of America as represented by the Secretary of the Navy, Washington, D.C.

[22] Filed: Apr. 1, 1974

[21] Appl. No.: 456,703

[52] U.S. Cl. ..... 149/19.3; 149/35; 149/42; 149/82; 149/83

[51] Int. Cl.[2] ..... C06B 45/10; C06B 35/00; C06B 33/06; C06B 29/12

[58] Field of Search ..... 149/19.3, 35, 77, 82, 149/83, 70, 71, 37, 42; 280/150 AB

[56] References Cited

UNITED STATES PATENTS

| | | | |
|---|---|---|---|
| 3,122,462 | 2/1964 | Kaufman | 149/35 |
| 3,155,553 | 11/1964 | Taylor | 149/35 |
| 3,326,731 | 6/1967 | Noddin | 149/35 |
| 3,629,020 | 12/1971 | Kaufman | 149/19.3 |
| 3,647,393 | 3/1972 | Leising | 149/72 |
| 3,723,205 | 3/1973 | Scheffee | 149/35 |
| 3,741,585 | 6/1973 | Hendrickson | 280/150 AB |
| 3,785,674 | 1/1974 | Poole | 280/150 AB |
| 3,833,432 | 9/1974 | Moy | 149/19.3 |

*Primary Examiner*—Samuel W. Engle
*Assistant Examiner*—Donald P. Walsh

[57] ABSTRACT

Cooled gas generating solid propellant, includes sodium azide or lithium azide as a nitrogen gas source, a fluorocarbon binder material, a combustion catalyst, and alkaline metal acid salt coolant.

13 Claims, No Drawings

COOLANT ADDITIVES FOR NITROGEN GENERATING SOLID PROPELLANTS

BACKGROUND OF THE INVENTION

This invention is related to solid propellants and more particularly to solid propellants which generate nitrogen gas at reduced temperatures.

The production of nitrogen gas is desired for many obvious reasons and applications. One such application is in inflatable devices in which, for safety purposes, it is preferable to accomplish inflation by the use of an inert gas. Nitrogen gas meets this objective. Other similar uses of nitrogen are well known in the art and require no further elaboration.

An especially suitable propellant for generating nitrogen is disclosed in U.S. Pat. application Ser. No. 14,827, filed Feb. 11, 1970, now. U.S. Pat. No. 3,833,432 and incorporated herein by reference. Sodium azide or lithium azide supply the nitrogen for the propellant. A suitable binder is a fluorocarbon. The propellant also contains a combustion catalyst. This propellant produces a very adequate supply of nitrogen and a chamber flame temperature of 2500°F to 4000°F. Such qualities render the propellant especially suitable for pressure feeding of liquid propellant rocket engines due to high gas production. In particular, the gas which is generated by this propellant has a low hydrogen content which renders it suitable for pressurizing an oxidizer system which uses inhibited red fuming nitric acid. When gas having a high content of hydrogen contacts inhibited red fuming nitric acid, undesirable side reactions may result. Thus, the absence of hydrogen in the gas-generating propellant renders it useful to pressurize the oxidizer system. The high flame temperature problem which results in corrosion and destruction of the rocket system is presently overcome by using heavier duty materials. A simpler means for controlling the system is desirable. Reducing the flame temperature is a possible means of eliminating the need for heavy duty material. Reducing the azide content of the propellant reduces the flame temperature. However, the production of reactive hydrogen is increased by this method, thereby causing side reactions in the above-referenced inhibited red fuming nitric acid system. The problem is to reduce the flame temperature which maintaining the desired inert gas analysis produced by the propellant.

A reduced flame temperature with an inert gas analysis makes the propellant suitable for other uses too.

The non-toxic and inert nature of nitrogen also renders it especially suitable for what is known as a man-rated device. A man-rated device provides a great service to man at relatively little danger. For example, the propellant which produces inert gases at a low flame temperature is suitable for use in escape and floatation devices. An inflatable life raft is compact, and the difference between life and death when inflated in an emergency. It is desirable to inflate the raft while minimizing the danger to man.

Because the propellant disclosed in the above-referenced U.S. Pat. application Ser. No. 14,827 filed Feb. 11, 1970, now U.S. Pat. No. 3,833,432 produces a high volume of non-toxic nitrogen gas quickly, it would be an especially suitable propellant for inflating a life-raft or other man-rated device, but the high-chamber flame temperature of 2500°F to 4000°F for the propellant, while perfectly suitable for the rocket applications disclosed therein, creates danger for a man if used in a man-rated device. The need for a nitrogen-producing propellant for use in man-rated devices combined with the knowledge that the above-referenced propellant while suitable for use in rockets also produces a substantial amount of nitrogen leads to a consideration of modifying the rocket propellant for use in a man-rated device, and to reduce flame damage in a rocket.

Reducing the azide concentration of the propellant, reduces the flame temperature which would render the composition suitable for use in a man-rated device where it not for the reduced nitrogen production of the exhaust gas which interfers with the ultimate function of quickly inflating a man-rated device, and were it not for the production of reactive hydrogen which destroys the non-toxic and inert features of the gas produced by the propellant.

The particular binder as disclosed is especially useful for the propellant of the above-referenced patent application. However, some fluorine containing material is produced when the propellant is burned. This fluorine containing material is also toxic. This is another factor to be considered when using the propellant in a man-rated device.

As a consequence, a man-rated gas generator propellant system requiring both low flame temperature (preferably below 1500°F) based on the propellant of the above-referenced application and an inert exhaust is not available due to the fact that the multitude of coolants available from the prior art have not been able to reduce the temperature, maintain the appropriate gas quantities, and maintain the desired inert qualities of the gas at the same time. In other words, it has not been possible to modify the solid gas generating propellant of the above-referenced application of use in man-rated devices.

SUMMARY OF THE INVENTION

It is, therefore, an object of this invention to provide a solid propellant for generating gas.

It is also an object of this invention to provide a solid propellant for generating a gas suitable for use in a man-rated device.

It is another object of this invention to provide a solid propellant having a reduced flame temperature.

Yet another object of this invention is to provide a solid propellant which generates a non-toxic, inert gas at a reduced flame temperature.

It is a further object of this invention to provide a solid propellant which is a gas generator and man-rated.

These and other objects of the invention are met by adding to a nitrogen producing propellant a coolant of an alkaline acid salt.

DESCRIPTION OF THE PREFERRED EMBODIMENTS

The gas generating propellant of this invention is based on lithium azide or sodium azide in a fluorocarbon matrix together with a combustion catalyst to which a coolant is added.

The azide preferred is sodium azide due to its high nitrogen content, availability and stability. Lithium azide also has a high nitrogen content, but is difficult to obtain and lacks stability as compared to sodium azide. Thus, while lithium azide is useful in this particular composition, and it is possible to mix lithium azide and sodium azide, sodium azide is more convenient to use.

Polymeric fluorocarbons are suitable for use as the matrix for this propellant. Perfluorinated polymers appears most suitable as the matrix or binder of the propellant. One example is, polytetrafluoroethylene (also known as TEFLON-an E. I. duPont trademark). Some partially fluorinated polymers are also suitable as the binder for the propellant. One suitable polymer is a rubbery copolymer of vinylidene fluoride and hexafluoropropylene (also known as VITON A). For the purposes of this invention, a fluorocarbon is defined as being either a fully fluorinated fluorocarbon consisting of carbon and fluorine, or a partially fluorinated fluorocarbon containing some other element or elements besides carbon and fluorine for example hydrogen, oxygen, nitrogen halogen, or other substituents. Where hydrogen cannot be tolerated as one of the combustion gases, the completely fluorinated or perfluorinated binder is desired. Many other polymers suitable for various binder uses are L 2344, a hydroxyterminated fluorocarbon of empirical formula $C_{73}F_{108}H_{42}O_2$ available from 3M Company, polynitrofluoroacrylates, polychlorotrifluoroethylene, a copolymer of chlorotrifluoroethylene and vinylidene fluoride or a copolymer of tetrafluoroethylene and perfluoropropylene.

The combustion catalyst is a finely divided silicon dioxide or a finely divided carbon black. The silicon dioxide has a surface area of at least 175 square meters per gram when used in one form of the propellant.

The preferred ratio of the binder, the catalyst and the azide together with a more thorough description of the propellant per se are set forth in U.S. Pat. application Ser. No. 14,827 filed Feb. 11, 1970, now U.S. Pat. No. 3,833,432 said application being incorporated herein by reference. The propellant percentages which are all based on the weight of the propellant are 50 to 75 percent azide, 25 to 40 percent binder, and up to 10 percent combustion catalyst.

It is now known by this invention that the addition of alkaline acid salts as coolants to the solid propellant comprising azide and fluorocarbon binder reduces chamber and exhaust flame temperature without compromising the essential inert chemical characteristics of the exhaust gases. Suitable alkaline salts are those of formic acid, carbonic acid, oxalic acid, tartaric acid, nitric acid, and mesoxalic acid. The alkaline component is selected from the group consisting of lithium, potassium, sodium, calcium, and strontium. A mixture of salts can also be used as the coolant. Sodium oxalate and sodium bicarbonate are especially convenient for use as the coolant either singly or in combination. The alkaline salt may comprise up to about 220% by weight or more suitably 5 to 15% by weight of the propellant. About 8 to 12 percent is also suitable for the alkaline salt by weight of the propellant.

Other optional additives to the propellant include alkaline salts of a halogen substituted organic acid and an oxidizer. This combination reacts with and assists the cooling function of the alkaline salts in the following manner:

$$2Cl_3CC(=O)ONa + Na_2C_2O_4 + Na_2ClO_4 \longrightarrow 7NaCl + 8CO_2.$$

The sodium perchlorate is the standard oxidizer. These additives produce inert gas and help the cooling function. Other oxidizers and alkali halogen substituted organic acid salts such as the illustrated sodium trichloroacetate also provide this function. Other suitable oxidizers are perchlorates and nitrates of sodium, potassium, calcium and barium. The halogen substituted acid salt is any suitable salt which will react to form inert materials under the given situations. The oxidizer and the halogen substituted acid salt while it can be used in any suitable amount are usually based on the amount of coolant. About 0 to 20 percent of the halogen substituted acid salt and 0–10 percent of the oxidizer is used. In one case the alkali halogen substituted organic acid salt if used is equal to the amount of coolant. The oxidizer is about one half of the alkali halogen substituted organic acid salt as shown by the above referenced equation.

Thus, the coolant serves the function of reducing the flame temperature while maintaining the desired level of inert gases. The coolant also reacts with the fluorine produced by the binder and renders it inert. The effect of the coolant is to lower the flame temperature and remove the toxic parts of the gas generated by the propellant without producing any harmful or toxic material itself.

The following examples are intended only to illustrate the invention without unduly limiting the invention.

Examples:

The propellant compositions are prepared and tested in standard fashion. The compositions in percent by weight and results are reported in the table.

Twenty grams of the following propellants are prepared:

PROPELLANT COMPOSITIONS, (%)

| | A | B | C** |
|---|---|---|---|
| Sodium azide | 58.0 | 58.0 | 68.0 |
| $SiO_2$ | 3.0 | 2.0 | 2.0 |
| Sodium oxalate | 10.0 | — | — |
| Sodium bicarbonate | — | 10.0 | — |
| Viton A | 30.0 | 30.0 | 30.0 |
| *Chamber temperature, (°F) | 2316 | 1096.0 | 2900 |
| *Exhaust temperature, (°F) | 1068 | 356.0 | 2200 |

*Theoretical Flame Temperature
**Control

All parts and percentages are based on the weight of the propellant unless otherwise stated. Propellants A and B of the invention produce as much inert gas as the control C at lower flame temperature.

Obviously, many modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A gas generating solid propellant comprising sodium azide, a fluorocarbon binder material, a combustion catalyst selected from the group consisting of a finely divided colloidal silicon dioxide, a finely divided carbon black, and mixtures thereof, an alkaline metal acid salt coolant, a halogen substituted organic acid salt and an oxidizer.

2. The propellant of claim 1 wherein the coolant is selected from the group consisting of alkaline metal salts of formic acid, carbonic acid, oxalic acid, tartaric acid, nitric acid and mesoxalic acid or mixtures thereof.

3. The propellant of claim 2 wherein the coolant is selected from the group consisting of sodium oxalate and sodium bicarbonate or mixtures thereof, the halogen substituted organic acid salt is sodium trichloroacetate and the oxidizer is sodium perchlorate.

4. The propellant of claim 2 wherein the halogen substituted organic acid salt is present in an amount equal to the amount of the coolant and the oxidizer is present in an amount equal to about one half of the amount of the coolant.

5. The gas generating solid propellant of claim 1 wherein said finely divided colloidal silicon dioxide is further characterized by having a minimum surface area of about 175 square meters per gram.

6. The gas generating solid propellant of claim 1 wherein said fluorocarbon binder material is a polymeric fully fluorinated fluorocarbon.

7. The gas generating solid propellant of claim 6 wherein said polymeric fully fluorinated fluorocarbon is polytetrafluoroethylene.

8. The gas generating solid propellant of claim 1 wherein said fluorocarbon binder material is a polymeric partially fluorinated fluorocarbon.

9. The gas generating solid propellant of claim 8 wherein said polymeric partially fluorinated fluorocarbon is selected from the group consisting of a copolymer of vinylidene fluoride and hexafluoropropylene, a hydroxy-terminated fluorocarbon, a homopolymer of chlorotrifluoroethylene and a copolymer of vinylidene fluoride and chlorotrifluoroethylene; and the coolant is at least one salt selected from the group consisting of an alkaline salt of carbonic acid, oxalic acid, formic acid, tartaric acid, nitric acid, and mesoxalic acid.

10. The gas generating solid propellant of claim 9 wherein said polymeric partially fluorinated fluorocarbon is a copolymer of vinylidene fluoride and hexafluoropropylene.

11. The gas generating solid propellant of claim 9 wherein said polymeric partially fluorinated fluorocarbon is a hydroxy terminated fluorocarbon, and the coolant is selected from the group consisting of sodium bicarbonate and sodium oxalate.

12. The gas generating solid propellant of claim 2 wherein said sodium azide and said fluorocarbon binder material are present in about stoichiometric quantities.

13. The gas generating solid propellant of claim 2 which further includes a metal selected from the group consisting of magnesium and aluminum.

* * * * *